US010444672B2

(12) United States Patent
Lior et al.

(10) Patent No.: US 10,444,672 B2
(45) Date of Patent: Oct. 15, 2019

(54) SPATIALLY SELECTIVE HEATING OF INTERMEDIATE TRANSFER MEMBER

(71) Applicant: HP INDIGO B.V., Amstelveen (NL)

(72) Inventors: Shai Lior, Rehovot (IL); Mark Sandler, Rehovot (IL); Peter Nedelin, Ashdod (IL); Guy Hamou, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,965

(22) PCT Filed: Apr. 22, 2015

(86) PCT No.: PCT/EP2015/058726
§ 371 (c)(1),
(2) Date: Jul. 24, 2017

(87) PCT Pub. No.: WO2016/169592
PCT Pub. Date: Oct. 27, 2016

(65) Prior Publication Data
US 2018/0017899 A1 Jan. 18, 2018

(51) Int. Cl.
*G03G 15/16* (2006.01)
*G03G 15/10* (2006.01)

(52) U.S. Cl.
CPC ..... *G03G 15/161* (2013.01); *G03G 15/10* (2013.01)

(58) Field of Classification Search
CPC ..... G03G 15/161; G03G 15/10–11
USPC ..... 399/308
See application file for complete search history.

(56) References Cited

U.S. PATENT DOCUMENTS

| | | | |
|---|---|---|---|
| 3,893,761 | A | 7/1975 | Buchan et al. |
| 4,974,027 | A | 11/1990 | Landa et al. |
| 4,999,677 | A | 3/1991 | Landa et al. |
| 5,917,530 | A | 6/1999 | Hutt et al. |
| 6,173,147 | B1 | 1/2001 | Nakashima et al. |
| 6,386,696 | B1 | 5/2002 | Rodi et al. |
| 7,127,202 | B2 | 10/2006 | Fujita et al. |

(Continued)

FOREIGN PATENT DOCUMENTS

| | | |
|---|---|---|
| CN | 1782922 | 6/2006 |
| CN | 102648440 | 8/2012 |
| WO | WO-2005040940 | 5/2005 |

OTHER PUBLICATIONS

Al-Rubaiey, H., "Toner Transfer and Fusing in Electrophotography", Graphic Arts in Finland 39(2010)1, Jun. 11, 2010, 28 pages.

*Primary Examiner* — Carla J Therrien
(74) *Attorney, Agent, or Firm* — Wall & Tong LLP

(57) ABSTRACT

In an example, an apparatus is described that includes a photosensitive imaging plate, an intermediate transfer member, and a heating unit. The photosensitive imaging plate attracts a layer of printing fluid. The intermediate transfer member contacts the photosensitive imaging plate and receives the layer of printing fluid from the photosensitive imaging plate. The heating unit includes an array of individually addressable heating elements and heats the intermediate transfer member in a manner that is spatially selective along two axes; a first axis in a direction of a width of the intermediate transfer member and a second axis in a direction of a rotation of the intermediate transfer member.

15 Claims, 5 Drawing Sheets

(56) References Cited

U.S. PATENT DOCUMENTS

| | | | | |
|---|---|---|---|---|
| 2004/0046860 | A1* | 3/2004 | Beier | B41C 1/05 347/238 |
| 2005/0025534 | A1* | 2/2005 | Fujita | G03G 15/1665 399/307 |
| 2007/0134030 | A1* | 6/2007 | Lior | G03G 15/11 399/307 |
| 2010/0238252 | A1 | 9/2010 | Dinescu et al. | |
| 2010/0245527 | A1* | 9/2010 | Sakita | B41J 2/473 347/224 |
| 2012/0237272 | A1* | 9/2012 | Sandler | G03G 15/10 399/302 |

* cited by examiner

300

SPATIALLY SELECTIVE HEATING OF INTERMEDIATE TRANSFER MEMBER

BACKGROUND

Digital printing technologies rely on the adhesion of printing fluid particles to a substrate to produce a printed item. The location of the printing fluid particles on the substrate, and in some cases the phase change of the printing fluid particles, is electrically controlled to produce a desired image. The image for an average customer printing job will cover approximately fifteen percent of the substrate with printing fluid.

DETAILED DESCRIPTION

The present disclosure broadly describes an apparatus, method, and non-transitory computer-readable medium for heating an intermediate transfer member (ITM) of a printing apparatus in a spatially selective manner. As discussed above, the location of printing fluid particles on a substrate is electrically controlled by a printing apparatus to produce a desired image on the substrate. Typically, the printing fluid particles are transferred to the ITM from a photo imaging plate (PIP), and the ITM is then heated to melt the printing fluid particles. The melted printing fluid particles are subsequently transferred to the substrate from the ITM. The printing fluid particles typically cover a fraction of the surface of the ITM, and yet printing apparatuses heat the entire ITM uniformly, including the portions of the ITM to which no printing fluid particles have been applied. Because the energy expended to heat the ITM is substantial, much energy is wasted on heating portions of the ITM that do not carry printing fluid. Moreover, the cooling mechanism of the printing apparatus expends additional energy in order to remove the extraneous heat.

Examples of the present disclosure provide an apparatus and method for heating an ITM of a printing apparatus in a spatially selective manner. For instance, examples of the present disclosure employ an array of individually addressable heating elements, such as high intensity laser emitters, in order to apply direct heat selectively to those portions of the ITM to which printing fluid has actually been applied. Thus, less than the entirety of the ITM is heated directly. The array provides for two axes of selectivity: a first axis in the direction of the ITM's width, and a second axis in the direction of the ITM's rotation. The total energy consumed in printing an image can thus be reduced dramatically, e.g., in some cases by as much as fifty to sixty percent.

Figure 1:
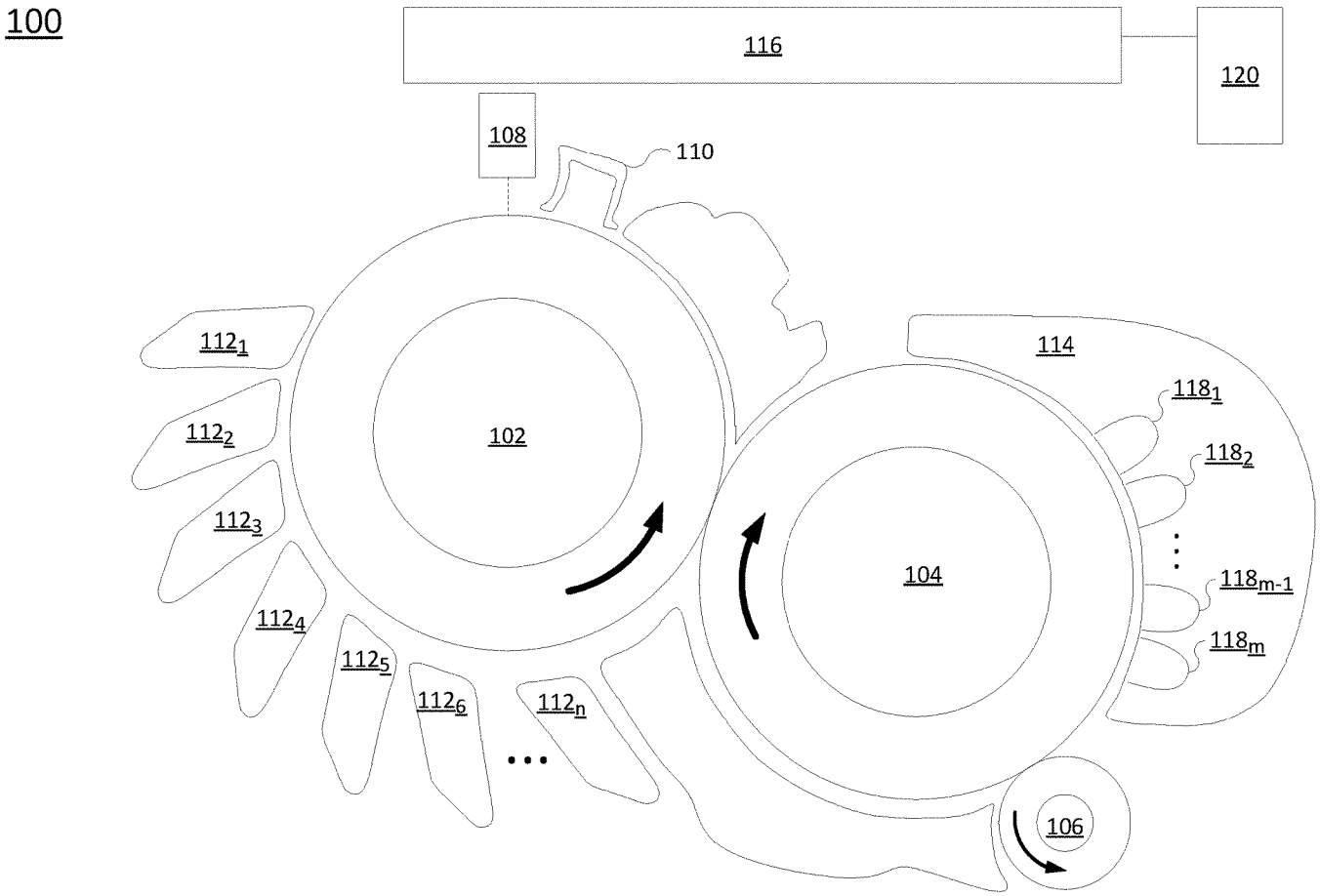
FIG. 1 is a block diagram of an example system of the present disclosure.

FIG. 1 illustrates an example system 100 of the present disclosure. In one example, the system 100 generally includes a photosensitive imaging plate 102, an intermediate transfer member 104, an impression press 106, a laser unit 108, a charge roller 110, a plurality of developers $\mathbf{112}_1$-$\mathbf{112}_n$ (hereinafter collectively referred to as "developers 112"), a heating unit 114, and a raster image processor 116. Any of these components may be controlled by a high-level controller 120, potentially in combination with a lower-level controller. The high-level controller 120 may be implemented in a computer, as discussed in connection with FIG. 6. The system 100 includes other components as well that are not directly pertinent to the present disclosure and are thus omitted for clarity. Thus, FIG. 1 represents a simplified illustration of the system 100.

The raster image processor 116 comprises a processor that converts a page description of an image to be printed into a mapping, such as a bitmap, that is stored in a memory of the system 100. The page description may be originally encoded in a language such as PostScript, Printer Command Language (PCL), Open Extensible Markup Language Paper Specification (OpenXPS), or other page description language used by two- or three-dimensional printing apparatuses prior to being converted into the mapping.

The photosensitive imaging plate (PIP) 102 comprises a photosensitive surface, such as a drum, a cylinder, a belt, or the like. Thus, the surface of the PIP 102 acts as a photoreceptor. The PIP 102 may comprise a plurality of layers, including, but not limited to, a photocharging layer, a charge leakage barrier layer, and/or an outer surface layer. Some of these layers may include silicon.

The charge roller 110 is positioned in proximity to the PIP 102 and comprises a unit that projects a uniform electrostatic charge onto the surface of the PIP 102 as the PIP 102 passes the charge roller 110, e.g., in the direction indicated by the arrow. In one example, the charge roller 110 negatively charges the surface of the PIP 102, e.g., up to one thousand volts.

The laser unit 108 is positioned in proximity to the PIP 102 and comprises a laser that is turned on and off by the mapping that is stored in memory. As the PIP 102 passes the laser, the surface of the PIP 102 is struck by the laser, and the negative charge on the surface of the PIP 102 is discharged. The result is a static electric negative image formed by a pattern of dots on the surface of the PIP 102.

The plurality of developers 112 is positioned in proximity to the PIP 102, e.g., roughly on an opposite side of the PIP 102 from the charge roller 110. In one example, each of the developers 112 contains printing fluid of a different color. The printing fluid may comprise, for example, ink, such as liquid electrophotographic ink. Liquid electrophotographic ink comprises a fluid mixture of carrier liquid, such as oil, and concentrated colorant particles. The colorant particles are relatively small and are spaced relatively far apart from each other when the ink is in its dilute liquid form.

In one example, the printing fluid is negatively charged. As a result, the printing fluid is attracted to the areas of the PIP 102 that were struck by the laser, i.e., the areas from which the negative charge has been discharged. Thus, as discharged surface of the PIP 102 passes the developers 112, printing fluid from the developers 112 electrically adheres to the surface of the PIP 102 in the areas where the negative charge has been discharged.

The intermediate transfer member (ITM) 104 comprises a transfer surface, such as a drum, a cylinder, a blanket, a belt, or the like. In one example, the ITM 104 is positioned in proximity to the PIP 102, roughly at the end of the plurality of developers 110. The ITM 104 contacts the PIP 102 directly over a small area. In one example, the ITM 104 rotates or moves in a direction opposite to the direction of rotation or movement of the PIP 102, e.g., as indicated by the arrow. Thus, if the PIP 102 rotates in a counterclockwise direction, the ITM 104 rotates in a clockwise direction. As the PIP 102 and the ITM 104 make contact, the printing fluid on the surface of PIP 102 is transferred to the surface of the ITM 104 electrostatically at the small area where the PIP 102 and the ITM 104 directly contact each other.

The heating unit 114 is positioned proximate to the ITM 104, in one example roughly on an opposite side of the ITM 104 from the PIP 102. The heating unit 114 selectively heats the ITM 104 after the printing fluid has been transferred to the surface of the ITM 104. Where the printing fluid comprises liquid electrophotographic ink, the heating causes the colorant particles to draw closer together. This in turn causes the texture of the ink to become tacky.

In one example, the heating unit 114 comprises a two-dimensional array of heating elements $\mathbf{118}_1$-$\mathbf{118}_m$ (hereinafter collectively referred to as "heating elements 118"). In a further example, the heating elements 118 comprise laser emitters, such as vertical cavity surface-emitting lasers (VCSELs); however, heating elements other than lasers may also be deployed. In one example, each of the heating elements 118 is individually addressable; however, in alternative examples, groups of heating elements 118 may be individually addressable.

The impression press 106 comprises an impression surface, such as a drum, a cylinder, a belt, or the like. In one example, the impression press 106 is positioned in proximity to the ITM 104. The impression press 106 contacts the ITM 104 directly over a small area. In one example, the impression press 106 rotates or moves in a direction opposite to the direction of rotation or movement of the ITM 104, e.g., as indicated by the arrow. Thus, if the ITM 104 rotates in a clockwise direction, the impression press 106 rotates in a counterclockwise direction. A substrate upon which an image is to be printed (not shown) is passed between the ITM 104 and the impression press 106 in the small area where the ITM 104 and the impression press 106 directly contact each other. As the ITM 104 and the impression press 106 make contact, the heated printing fluid is transferred from the outer surface of the ITM 104 onto the substrate as a thin layer. The printing fluid then dries on the substrate, resulting in a printed image.

The array of individually addressable heating elements 118 allows the ITM 104 to be heated in a non-uniform, spatially selective manner, e.g., such that less than an entirety of the ITM 104 is directly heated. For instance, those portions of the ITM 104 that carry printing fluid, and possibly some small background areas, are heated directly. The portions of the ITM 104 that do not carry printing fluid are not heated directly, but may absorb a negligible amount of heat from neighboring regions that are directly heated. This minimizes the amount of energy that is wasted on the heating of the printing fluid.

The array provides for two axes of selectivity: a first axis in the direction of the ITM's width, and a second axis in the direction of the ITM's rotation or movement. The number of individually addressable heating elements 118 in the array and the physical dimensions, e.g., width, height, and pitch, of the heating elements 118 may be selected to tune the energy efficiency of the system. For instance, using a greater number of smaller individually addressable heating elements may result in greater energy savings than using fewer larger heating elements. The numerical apertures of the heating elements 118 and the distance of the heating elements 118 to the ITM 104 may also be selected to tune the system's energy efficiency.

Figure 2:
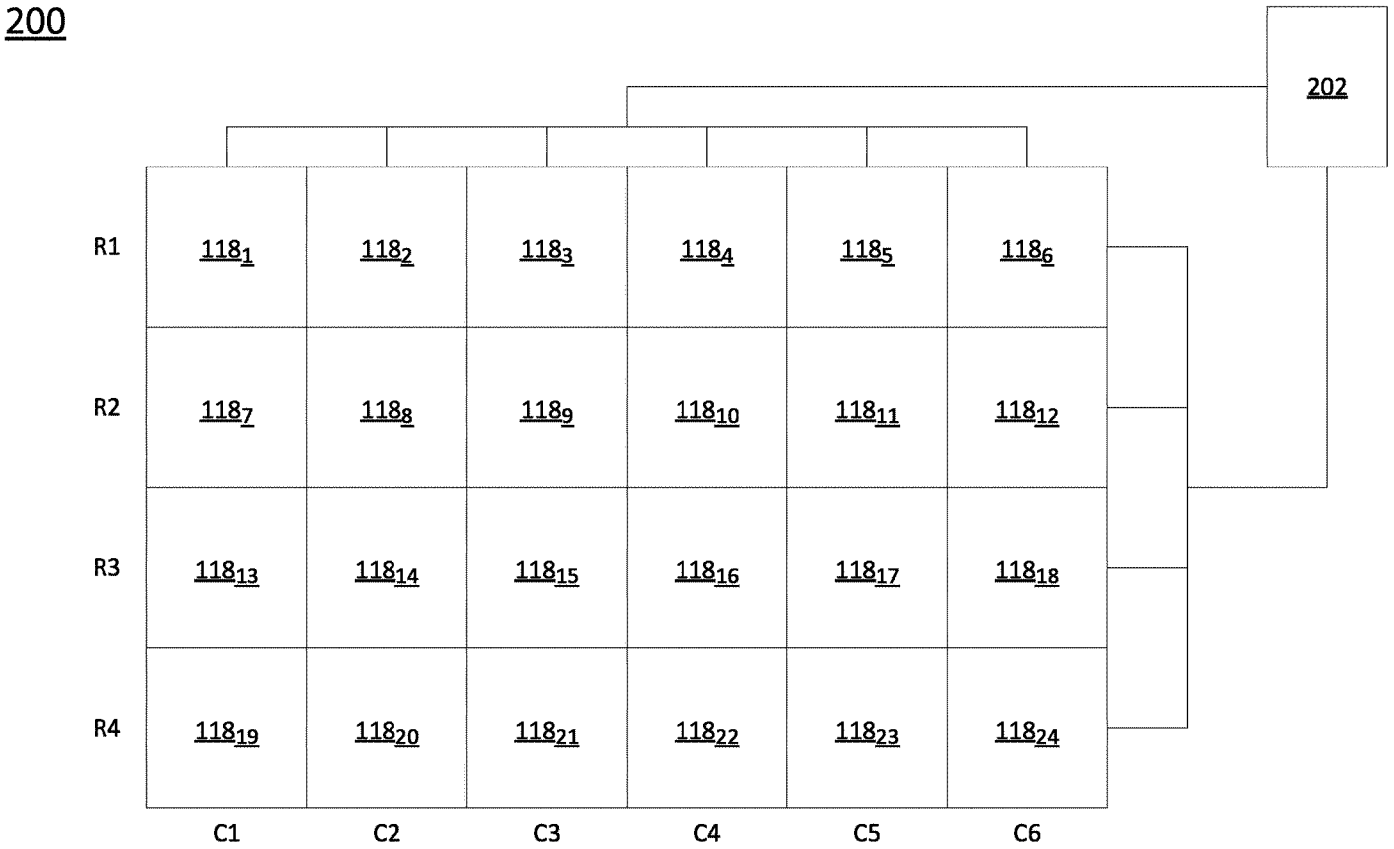
FIG. 2 illustrates an example array of heating elements, for instance as disclosed in connection with FIG. 1.

FIG. 2 illustrates an example array 200 of heating elements 118, for instance as disclosed in connection with FIG. 1. As illustrated, the array 200 comprises a plurality of rows R1-R4 and a plurality of columns C1-C6. Although four rows and six columns are illustrated, it will be appreciated that any number of rows and columns may be implemented in the array 200. In one example, the rows extend along the direction of the ITM's width, while the columns extend in the direction of the ITM's rotation or movement. Thus, as discussed above, more fine-grained spatial selectivity can be achieved by increasing the number of heating elements contained in a row and/or column.

At each intersection of a row and column is a heating element $\mathbf{118}_1$-$\mathbf{118}_{24}$. Again, although twenty-four heating elements 118 are illustrated, it will be appreciated that any number of heating elements 118 may be implemented in the array 200. As discussed above, each heating element 118 may comprise a laser emitter, such as a VCSEL emitter.

The array 200 is coupled to a controller 202. The controller 202 may be implemented in a computer, as discussed in connection with FIG. 6. The controller 202 controls which of the heating elements 118 are activated at a given time, based on the portions of the ITM 104 that carry printing fluid. As discussed above, the heating elements 118, or in some cases groups of two or more heating elements 118, are individually addressable by the controller 202. In one example, each row and each column of the array 200 is individually connected to the controller 202. In this example, the controller may 202 addresses a particular heating element 118 by addressing the row and the column within which the particular heating element resides. For instance, if the controller 202 needed to address heating element $\mathbf{118}_9$, the controller 202 could do so by addressing row R2 and column C3. This configuration provides one way of arranging the heating elements 118 in a manner that makes them individually addressable by the controller 202. The controller 202 may be further coupled to another, higher-level controller that coordinates the operations of different components of the system 100, such as the high-level controller 120 of FIG. 1.

In an alternative example, the array 200 may comprise a single row of heating elements 118. In this case, the single row extends along the direction of the ITM's width. As the ITM 104 revolves or moves past the single row of static heating elements 118, the heating elements 118 can be addressed to heat any printing fluid particles in a given section of the ITM's width.

Figure 3:
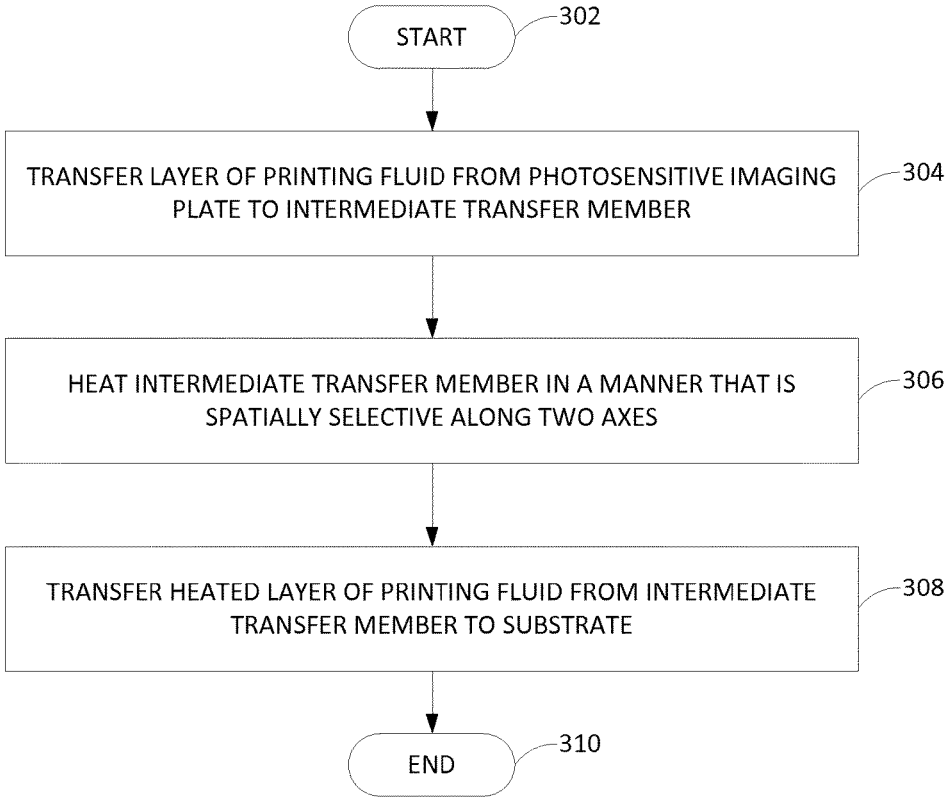
FIG. 3 illustrates a flowchart of an example method for heating an intermediate transfer member of a printing apparatus in a spatially selective manner.

FIG. 3 illustrates a flowchart of an example method 300 for heating an intermediate transfer member of a printing apparatus in a spatially selective manner. The method 300 may be performed, for example, by the system 100 illustrated in FIGS. 1 and 2. It will be appreciated, however, that the method 300 is not limited to implementation with the system illustrated in FIGS. 1 and 2.

The method 300 begins in block 302. In block 304, a layer of printing fluid is transferred from a photosensitive imaging plate, such as a PIP drum of a printing apparatus, to an intermediate transfer member, such as an ITM drum of the printing apparatus. The layer of printing fluid forms an image to be printed on a substrate. Thus, transfer of the layer of printing fluid results in printing fluid being applied to some regions of the intermediate transfer member, i.e., the regions carrying the image, but not to other regions. Other portions of the intermediate transfer member, i.e., the portions not carrying the image, are left free of printing fluid. In one example, the printing fluid comprises liquid electrophotographic ink.

In block 306, the intermediate transfer member is heated in a spatially selective manner to heat the layer of printing fluid. The heating heats the intermediate transfer member in a manner that is spatially selective along two axes: a first axis in the direction of the width of the intermediate transfer member and a second axis in the direction of rotation or movement of the intermediate transfer member. This allows direct heat to be applied to those portions of the intermediate transfer member to which the layer of printing fluid has been applied, while avoiding direct heat to those portions of the intermediate transfer member to which printing fluid has not been applied. The portions of the intermediate transfer member that are free of printing fluid are not directly heated, although some residual heat from neighboring portions that have been directly heated may warm the printing fluid-free portions to some degree. Thus, less than the entirety of the intermediate transfer member is heated directly. In one example, the spatially selective heating is performed using a two-dimensional array of heating elements, such as an array of VCSEL emitters.

In block 308, the heated layer of printing fluid is transferred from the intermediate transfer member to the substrate, resulting in an image being printed on the substrate.

The method 300 then ends in block 310.

Figure 4:
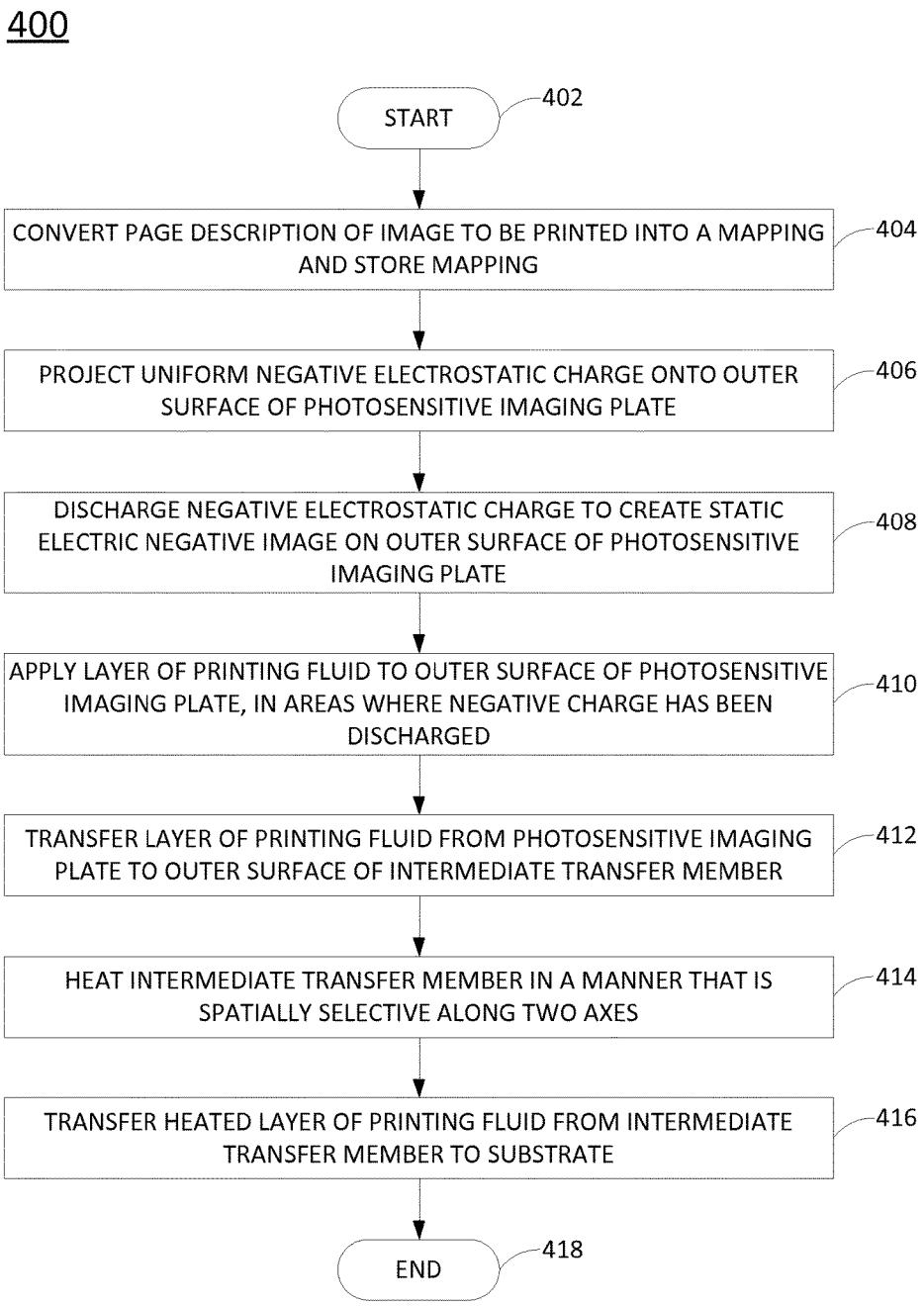
FIG. 4 illustrates a flowchart of an example method for printing an image on a substrate.

FIG. 4 illustrates a flowchart of an example method 400 for printing an image on a substrate. The method 400 includes blocks for heating an intermediate transfer member of a printing apparatus in a spatially selective manner, as discussed above in connection with FIG. 3. The method 400 may be performed, for example, by the system 100 illustrated in FIGS. 1 and 2. It will be appreciated, however, that the method 400 is not limited to implementation with the system illustrated in FIGS. 1 and 2.

The method 400 begins in block 402. In block 404, a page description of the image to be printed is converted from a page description into a mapping, such as a bitmap. The page description may be originally encoded in a language such as PostScript, PCL, or OpenXPS prior to being converted into the mapping. The conversion from the page description to the mapping may be performed by a raster image processor of a printing apparatus. The mapping is stored, for example in a memory of the printing apparatus.

In block 406, a uniform negative electrostatic charge is projected onto a photosensitive imaging plate, such as a PIP drum of a printing apparatus. The electrostatic charge may be projected using a charge roller of the printing apparatus, as the surface of the photosensitive imaging plate passes the charge roller.

In block 408, the negative charge on the photosensitive imaging plate is discharged. The charge may be discharged using a laser that is turned on and off, as the photosensitive imaging plate passes the laser, in accordance with the mapping of the image that is stored in the memory of the printing apparatus. Discharge of the negative charge results in a static electric negative image, for example formed by a pattern on dots, being formed on the surface of the photosensitive imaging plate.

In block 410, a layer of printing fluid is applied to the surface of the photosensitive imaging plate. In one example, the printing fluid is negatively charged, such that the printing fluid is attracted to the areas on the photosensitive imaging plate that were struck by the laser, i.e., the areas from which the negative charge has been discharged. Thus, the layer of printing fluid forms an image to be printed on a substrate. As such, printing fluid is applied to some regions of the photosensitive imaging plate, i.e., the regions carrying the image, but not to other regions. The printing fluid may be contained in a developer of the printing apparatus, and the printing fluid may be dispensed from the developer as the photosensitive imaging plate passes the developer. The printing fluid may comprise liquid electrophotographic ink. In this case, the colorant particles in the ink will be relatively small and spaced relatively far apart from each other when the ink is in a dilute liquid form.

In block 412, the layer of printing fluid is electrostatically transferred from the photosensitive imaging plate to an intermediate transfer member, such as an ITM drum of the printing apparatus. The layer of printing fluid may be transferred as the photosensitive imaging plate and the intermediate transfer member rotate relative to each other, e.g., in opposite directions of rotation, and make contact. Transfer of the layer of printing fluid results in printing fluid being applied to some regions of the intermediate transfer member's surface, i.e., the regions carrying the image, but not to other regions. Other portions of the intermediate transfer member's surface, i.e., the portions not carrying the image, are left free of printing fluid.

In block 414, the intermediate transfer member is heated in a spatially selective manner to heat the layer of printing fluid. The heating heats the intermediate transfer member's surface in a manner that is spatially selective along two axes: a first axis in the direction of the width of the intermediate transfer member and a second axis in the direction of rotation of the intermediate transfer member. This allows direct heat to be applied to those portions of the intermediate transfer member's surface to which the layer of printing fluid has been applied, while avoiding application of direct heat to portions of the intermediate transfer member that do not carry printing fluid. The portions of the intermediate transfer member's surface that are free of printing fluid are not directly heated, although some residual heat from neighboring portions that have been directly heated may warm the printing fluid-free portions to some degree. Thus, less than the entirety of the intermediate transfer member is heated directly. In one example, the spatially selective heating is performed using a heating unit of the printing apparatus, as the intermediate transfer member rotates past the heating unit. The heating unit may comprise a two-dimensional array of heating elements, such as an array of VCSEL emitters. In one example, each of the heating elements is individually addressable; however, in alternative examples, groups of heating elements may be individually addressable.

In block 416, the heated layer of printing fluid is transferred from the intermediate transfer member to the substrate, resulting in an image being printed on the substrate. In one example, the substrate is passed between the intermediate transfer member and another apparatus, such as an impression press of the printing apparatus, as the intermediate transfer member and the other apparatus rotate or move relative to each other in opposite directions of rotation.

The method 400 ends in block 418. The printing fluid will subsequently dry on the substrate, resulting in a printed image.

Figure 5:
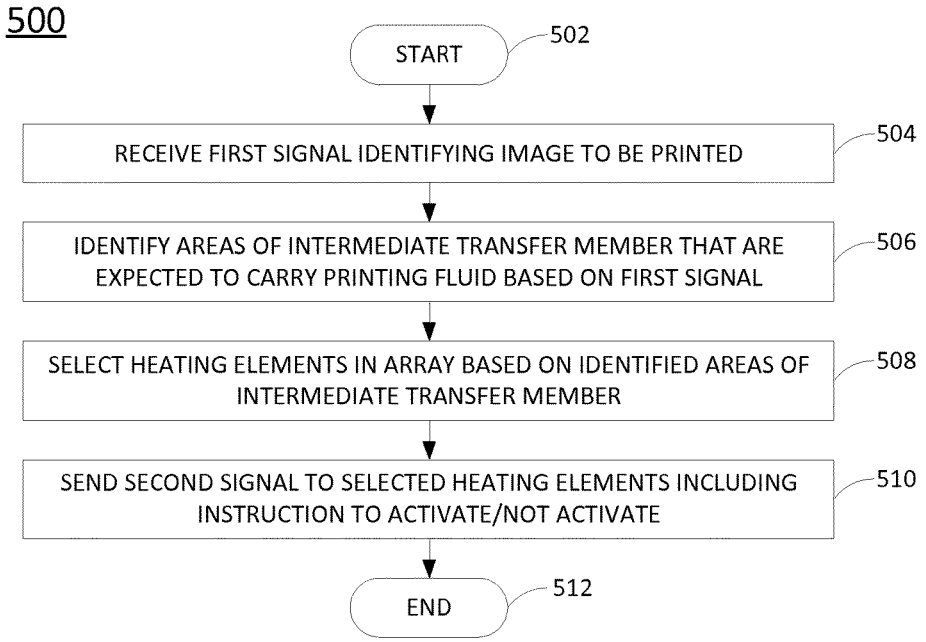
FIG. 5 illustrates a flowchart of an example method for heating an intermediate transfer member of a printing apparatus in a spatially selective manner.

FIG. 5 illustrates a flowchart of an example method 500 for heating an intermediate transfer member of a printing apparatus in a spatially selective manner. The method 500 may be performed, for example, by a controller that controls an array of heating elements, such as the controller 202 illustrated in FIG. 2. It will be appreciated, however, that the method 500 is not limited to implementation with the system illustrated in FIG. 2.

The method 500 begins in block 502. In block 504, a first signal is received identifying an image to be printed. The first signal may include, for example, a mapping, such as a mapping created by a raster image processor of a printing apparatus.

In block 506, the areas of an intermediate transfer member that are expected to carry printing fluid are identified, based on the first signal.

In block 508, at least one heating element in an array of heating elements is selected, based on the identified areas of the intermediate transfer member. In one example, the selected heating elements are located in positions in the array that are expected to encounter the areas of the intermediate transfer member that carry printing fluid. In an alternative example, the selected heating elements are located in positions in the array that are expected to encounter the areas of the intermediate transfer member that are free of printing fluid In block 510, a second signal is sent to each of the selected heating elements. In one example, where the selected heating elements are expected to encounter the areas of the intermediate transfer member that carry printing fluid, the second signal instructs the heating elements to activate, i.e., to heat an area of the intermediate transfer member as it passes the heating elements. The second signal may further include an instruction as to when and for how long the heating element should activate. In an alternative example, where the selected heating elements are expected to encounter areas of the intermediate transfer member that are free of printing fluid, the second signal instead instructs the heating elements to not activate. In one example, a heating element in an array is addressed by addressing the row and the column in which the heating element resides. For instance, to activate the heating element $\mathbf{118}_9$ in FIG. 2, the second signal would be addressed to row R2 and column C3.

The method 500 ends in block 512.

It should be noted that although not explicitly specified, some of the blocks, functions, or operations of the methods 300, 400, and 500 described above may include storing, displaying and/or outputting for a particular application. In other words, any data, records, fields, and/or intermediate results discussed in the methods can be stored, displayed, and/or outputted to another device depending on the particular application. Furthermore, blocks, functions, or operations in FIGS. 3-5 that recite a determining operation, or involve a decision, do not necessarily imply that both branches of the determining operation are practiced. In other words, one of the branches of the determining operation can be deemed to be optional.

Figure 6:
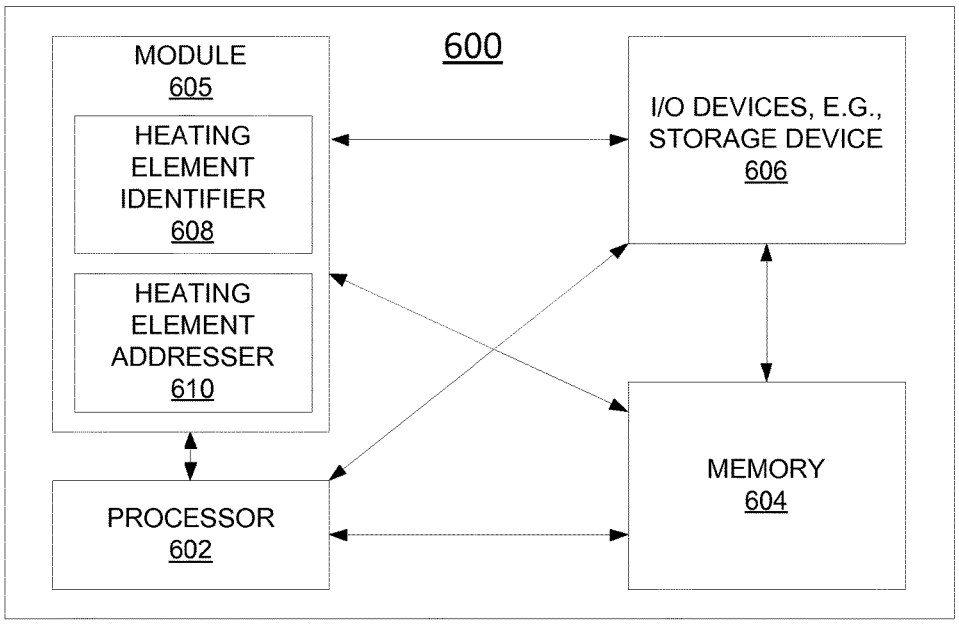
FIG. 6 depicts a high-level block diagram of an example computer that can be transformed into a machine capable of performing the functions described herein.

FIG. 6 depicts a high-level block diagram of an example computer that can be transformed into a machine capable of performing the functions described herein. Notably, no computer or machine currently exists that performs the functions as described herein. As a result, the examples of the present disclosure modify the operation and functioning of the general-purpose computer to heat an intermediate transfer member of a printing apparatus in a spatially selective manner, as disclosed herein.

As depicted in FIG. 6, the computer 600 comprises a hardware processor element 602, e.g., a central processing unit (CPU), a microprocessor, or a multi-core processor, a memory 604, e.g., random access memory (RAM) and/or read only memory (ROM), a module 605 for heating an intermediate transfer member of a printing apparatus in a spatially selective manner, and various input/output devices 606, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers. Furthermore, a hardware processor can be utilized in supporting a virtualized or shared computing environment. The virtualized computing environment may support a virtual machine representing computers, servers, or other computing devices. In such virtualized virtual machines, hardware components such as hardware processors and computer-readable storage devices may be virtualized or logically represented.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the blocks, functions and/or operations of the above disclosed methods.

In one example, instructions and data for the present module or process 605 for heating an intermediate transfer member of a printing apparatus in a spatially selective manner, e.g., machine readable instructions can be loaded into memory 604 and executed by hardware processor element 602 to implement the blocks, functions or operations as discussed above in connection with the methods 300, 400, and 500. For instance, the module 605 may include a plurality of programming code components, including a heating element identifier component 608 and a heating element addresser component 610. These programming code components may be included, for example, on a controller that controls an array of heating elements, such as the controller 202 of FIG. 2.

The heating element identifier component 608 may be configured to identify heating elements to be activated or not activated in an array of heating elements. These heating elements may be identified based on a stored mapping of an image, as discussed above.

The heating element addresser component 610 may be configured to address individual heating elements in the array with instructions to activate or not activate. Thus, the heating element addresser component 610 may operate in cooperation with the heating element identifier component 608 to ensure that the intermediate transfer member of a printing apparatus is heated in a spatially selective manner.

Furthermore, when a hardware processor executes instructions to perform "operations", this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present module 605 for heating an intermediate transfer member of a printing apparatus in a spatially selective manner, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made which are also intended to be encompassed by the following claims.

What is claimed is:

1. An apparatus, comprising:

a photosensitive imaging plate (PIP) for attracting a layer of printing fluid;

a charge roller positioned in proximity to the PIP to project a uniform electrostatic charge onto a surface of the PIP as the PIP rotates;

a laser unit positioned in proximity to the PIP and after the charge roller to selectively remove electrostatic charge on the surface of the PIP to form an image as the PIP rotates;

a plurality of developers positioned in proximity to the PIP after the laser unit to dispense the layer of printing fluid onto the surface of the PIP having an electrostatic charge as the PIP rotates;

an intermediate transfer member (ITM) contacting the PIP, for receiving the layer of printing fluid from the PIP as the ITM rotates in a direction that is opposite a direction of rotation of the PIP;

a heating unit positioned in proximity to the ITM and opposite the PIP, wherein the heating unit comprises an array of individually addressable heating elements for heating the ITM in a manner that is spatially selective along a first axis in a direction of a width of the ITM and along a second axis in a direction of a rotation of the ITM;

an impression press positioned in proximity to the ITM that rotates in a direction that is opposite the direction of rotation of the ITM and transfers the image onto a substrate that passes through between the ITM and the impression press; and a controller to control operation of the laser unit, the plurality of developers, and each one of the individually addressable heating elements of the array, wherein the controller is to identify areas on the ITM that are free from the layer of printing fluid based on a mapping created by a raster image processor and to generate a signal to not activate a subset of the individually addressable heating elements that correspond to the areas on the ITM that are free from the layer of printing fluid.

2. The apparatus of claim 1, wherein each of the individually addressable heating elements comprises a laser emitter.

3. The apparatus of claim 2, wherein each of the individually addressable heating elements comprises a vertical cavity surface-emitting laser emitter.

4. The apparatus of claim 1, wherein the array comprises at least one row and a plurality of columns, and each of the individually addressable heating elements is positioned at an intersection of one of the at least one row and one of the plurality of columns.

5. The apparatus of claim 4, wherein each of the at least one row and each of the plurality of columns is connected to a controller that sends signals to the individually addressable heating elements.

6. The apparatus of claim 1, wherein the layer of printing fluid comprises a layer of liquid electrophotographic ink.

7. A method, comprising:

projecting a uniform electrostatic charge onto a surface of a photosensitive imaging plate (PIP) via a charge roller in proximity to the PIP as the PIP rotates;

selectively removing electrostatic charge on the surface of the PIP to form an image via a laser unit positioned in proximity to the PIP as the PIP rotates;

transferring a layer of printing fluid onto the surface of the PIP having an electrostatic charge via a plurality of developers positioned in proximity to the PIP as the PIP rotates;

transferring the layer of printing fluid to an intermediate transfer member (ITM) that rotates in a direction that is opposite a direction of rotation of the PIP;

identifying areas of the ITM that are free from the layer of printing fluid based on a mapping created by a raster image processor;

subsequent to transferring the layer of printing fluid to the ITM, generating a signal to not activate a subset of individually addressable heating elements of an array of individually addressable heating elements that correspond to the areas of the ITM that are free from the layer of printing fluid, while heating the ITM in a manner that is spatially selective along a first axis in a direction of a width of the ITM and along a second axis in a direction of a rotation of the ITM; and subsequent to heating the ITM, transferring the layer of printing fluid from the ITM to a substrate that is passed between an impression press and the ITM, wherein the impression press is positioned in proximity to the ITM and rotates in a direction that is opposite the direction of rotation of the ITM.

8. The method of claim 7, wherein the printing fluid comprises liquid electrophotographic ink.

9. The method of claim 7, wherein the heating comprises:

applying heat from at least one heating element in an array of individually addressable heating elements.

10. The method of claim 9, wherein each of the individually addressable heating elements comprises a laser emitter.

11. The method of claim 10, wherein each of the individually addressable heating elements comprises a vertical cavity surface-emitting laser emitter.

12. The method of claim 9, wherein the array comprises at least one row and a plurality of columns, and each of the individually addressable heating elements is positioned at an intersection of one of the at least one row and one of the plurality of columns.

13. The method of claim 7, wherein the heating results in direct heat being applied to less than an entirety of the ITM.

14. A non-transitory machine-readable storage medium encoded with instructions executable by a processor, the machine-readable storage medium comprising:

instructions to project a uniform electrostatic charge onto a surface of a photosensitive imaging plate (PIP) via a charge roller in proximity to the PIP as the PIP rotates;

instructions to identify an area of a photosensitive imaging plate (PIP) that will receive a layer of printing fluid;

instructions to selectively remove charge on a surface of the PIP except for portions of the surface that will receive the layer of printing fluid as the PIP rotates;

instructions to transfer the layer of printing fluid onto the surface of the PIP having an electrostatic charge via a plurality of developers positioned in proximity to the PIP as the PIP rotates;

instructions to transfer the layer of printing fluid to an intermediate transfer member (ITM) that rotates in a direction that is opposite a direction of rotation of the PIP;

instructions to identify areas of the ITM that are free from the layer of printing fluid based on a mapping created by a raster image processor;

instructions to, subsequent to the instructions to transfer the layer of printing fluid to the ITM, generate a signal to not activate a subset of individually addressable heating elements of an array of individually addressable heating elements that correspond to the areas of the ITM that are free from the layer of printing fluid, while heating the ITM using remaining individually addressable heating elements of the array of individually addressable heating elements, wherein the array is arranged to provide heat in a manner that is spatially selective along a first axis in a direction of a width of the ITM and along a second axis in a direction of a rotation of the ITM; and instructions to transfer the layer of printing fluid from the ITM to a substrate that is passed between an impression press and the ITM, wherein the impression press is positioned in proximity to the ITM and rotates in a direction that is opposite the direction of rotation of the ITM.

15. The non-transitory machine-readable storage medium of claim 14, wherein the instructions to heat result in direct heat being applied to less than an entirety of the ITM.

* * * * *